US010369778B2

(12) United States Patent
Desmet et al.

(10) Patent No.: US 10,369,778 B2
(45) Date of Patent: Aug. 6, 2019

(54) INKJET CTP METHOD FOR PREPARING A SET OF LITHOGRAPHIC PRINTING PLATES

(71) Applicant: AGFA NV, Mortsel (BE)

(72) Inventors: Tim Desmet, Mortsel (BE); Jens Lenaerts, Mortsel (BE); Patrick Van Den Bergen, Mortsel (BE)

(73) Assignee: AGFA NV, Mortsel (BE)

( * ) Notice: Subject to any disclaimer, the term of this patent is extended or adjusted under 35 U.S.C. 154(b) by 237 days.

(21) Appl. No.: 15/524,818

(22) PCT Filed: Nov. 2, 2015

(86) PCT No.: PCT/EP2015/075369

§ 371 (c)(1),
(2) Date: May 5, 2017

(87) PCT Pub. No.: WO2016/071250

PCT Pub. Date: May 12, 2016

(65) Prior Publication Data

US 2018/0304610 A1 Oct. 25, 2018

(30) Foreign Application Priority Data

Nov. 6, 2014 (EP) ..... 14192062
Dec. 4, 2014 (EP) ..... 14196212

(51) Int. Cl.
*B41C 1/10* (2006.01)
*B41C 1/12* (2006.01)

(52) U.S. Cl.
CPC ..... *B41C 1/1066* (2013.01); *B41C 1/1083* (2013.01); *B41C 1/12* (2013.01)

(58) Field of Classification Search
CPC ..... B41C 1/12
See application file for complete search history.

(56) References Cited

U.S. PATENT DOCUMENTS

2004/0221757 A1 11/2004 Fowlkes et al.

FOREIGN PATENT DOCUMENTS

WO 91/11877 A1 8/1991
WO 2005/105463 A1 11/2005

OTHER PUBLICATIONS

Official Communication issued in International Patent Application No. PCT/EP2015/075369, dated Jan. 28, 2016.

*Primary Examiner* — Joshua D Zimmerman
(74) *Attorney, Agent, or Firm* — Keating and Bennet, LLP

(57) ABSTRACT

A method of preparing a first and second lithographic printing plate for lithographic printing of a color digital image on a receiver wherein the color digital image includes a plurality of colorant separations; the method including the steps of jetting droplets by an inkjet CTP system on a first lithographic support for the first lithographic printing plate thereby forming a printing area of a first lithographic image which represents a first colorant separation of the plurality of colorant separations; and jetting droplets by the inkjet CTP system on a second lithographic support for the second lithographic printing plate thereby forming a printing area of a second lithographic image which represents a second colorant separation of the plurality of colorant separations; and wherein the method of preparing a first and second lithographic printing plates is characterized by forming a part of or whole the first and second lithographic image in a print pass by the inkjet CTP system.

13 Claims, 3 Drawing Sheets

INKJET CTP METHOD FOR PREPARING A SET OF LITHOGRAPHIC PRINTING PLATES

CROSS REFERENCE TO RELATED APPLICATIONS

This application is a 371 National Stage Application of PCT/EP2015/075369, filed Nov. 2, 2015. This application claims the benefit of European Application No. 14192062.9, filed Nov. 6, 2014 and European Application No. 14196212.6, filed on Dec. 4, 2014, which are incorporated by reference herein in its entirety.

BACKGROUND OF THE INVENTION

1. Field of the Invention

The present invention relates to a method of preparing a set of lithographic printing plates simultaneously by an inkjet CTP device wherein the set of lithographic printing plates represent a colorant separation of the same colour digital image.

2. Description of the Related Art

Computer-to-plate (CTP) is a technology that allows the imaging of metal or polyester plates without the use of film. By eliminating the stripping, compositing, and traditional plate making processes, CTP altered the printing industry, which led to reduced prepress times, lower costs of labour, and improved print quality.

Most CTP systems used thermal CTP as opposed to violet CTP, though both systems are effective, depending on the needs of the printing job.

A thermal CTP method involves the use of thermal lasers to expose and/or remove areas of coating while the lithographic printing plate precursor is being imaged. These lasers are generally at a wavelength of 830 nanometers, but vary in their energy usage depending on whether they are used to expose or ablate material.

A violet CTP method involves the use of lasers with a much lower wavelength, for example 405-410 nanometers. Violet CTP is based on emulsion, comprised in the lithographic printing plate precursor, tuned to visible light exposure.

To obtain a lithographic printing plate by thermal or violet CTP additional steps to the exposure are often necessary such as for example a preheat step, a developing step, a baking step, a gumming step or drying step. Each additional step is time and energy and chemistry consuming and may involve extra devices such as a gumming unit, a baking oven.

An inkjet CTP method involves a simplification of the preparation of lithographic printing plates wherein the printing areas of a lithographic image are applied on a lithographic support by jetting droplets. An advantage of inkjet CTP is that no chemical processing is needed to prepare a lithographic printing plate. An example of an inkjet CTP method is disclosed in EP 05736134 A (GLUNZ) wherein one after the other lithographic printing plate is prepared by an inkjet print device.

To lithographic print a colour digital image with a plurality of colorant separations by a printing press, for each colorant separation a lithographic printing plate has to be prepared. If the lithographic printing plates are prepared by an inkjet CTP method, the colour-on-colour registration of the printed colour digital images is in the state of the art very demanding and time consuming at the alignment of the lithographic supports in the offset press because the accuracy on the positioning of the lithographic images is in the state of the art insufficient. This low accuracy is caused by the dot placement of the print heads and the support feeding and aligning of the lithographic supports in the inkjet CTP system.

Hence, there is still a need for an improved method for preparing lithographic printing plates by an inkjet CTP method.

SUMMARY OF THE INVENTION

In order to overcome the problems described above the present invention has been realised with a method for preparing lithographic printing plates by an inkjet CTP method as defined below.

Further advantages and preferred embodiments of the present invention will become apparent from the following description.

DETAILED DESCRIPTION OF THE PREFERRED EMBODIMENTS

Figure 1:
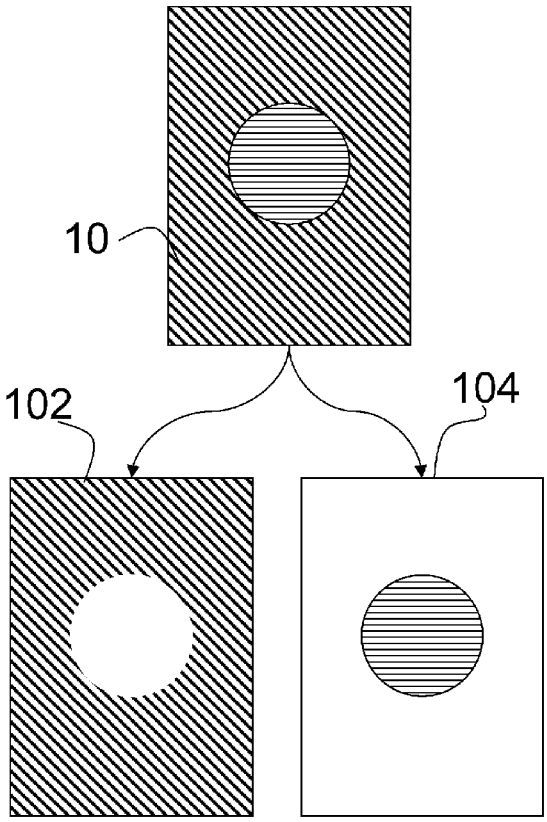
FIG. 1 illustrates a colour digital image (10) wherein a pixel is a combination of two colorants. The colour digital image (10) comprises two colorant separations (102, 104).
Figure 2:
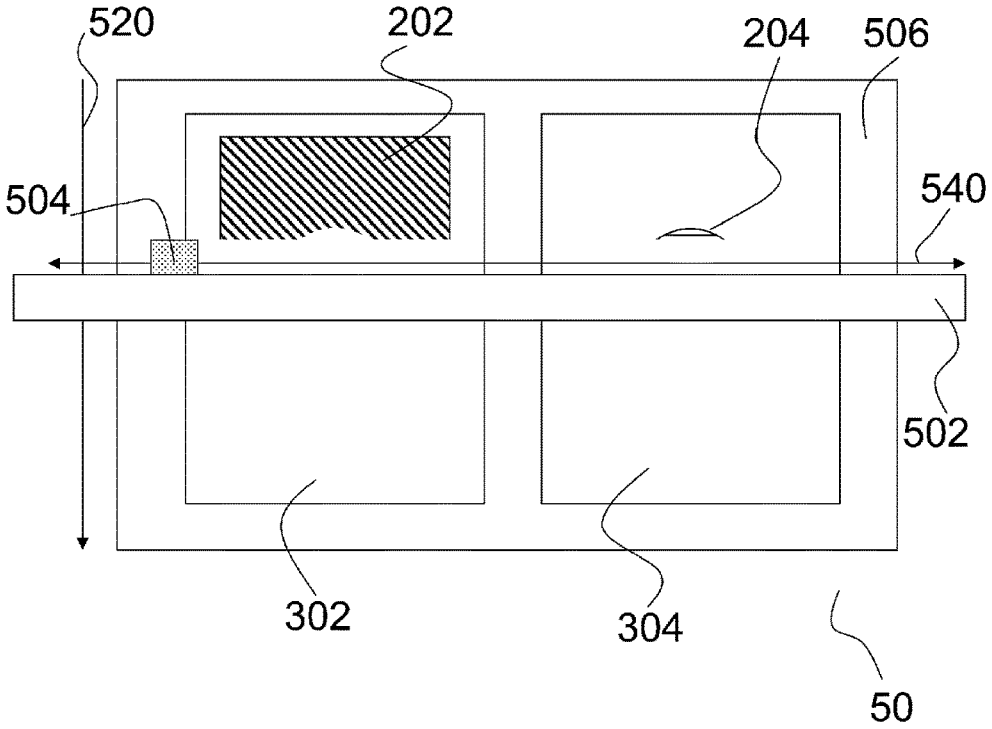
FIG. 2 illustrates a topview of an inkjet CTP system (50) wherein the forming of printing areas is performed by scanning an inkjet printing device (504) over the lithographic supports (302, 304) in the fastscan direction (540) and moving the lithographic supports (302,304) underneath the inkjet printing device (504) in the slowscan direction (520), also called a multi-pass inkjet printing method. On the first lithographic support a part of the printing area, (202) corresponding to the first colorant separation of FIG. 1 is jetted and on the second lithographic support a part of the printing area (204), corresponding to the second colorant separation of FIG. 1 is jetted. The lithographic supports (302, 304) are supported on a support table (516) of the inkjet CTP system (50). The inkjet printing device (504) is mounted on a gantry (502).
Figure 3:
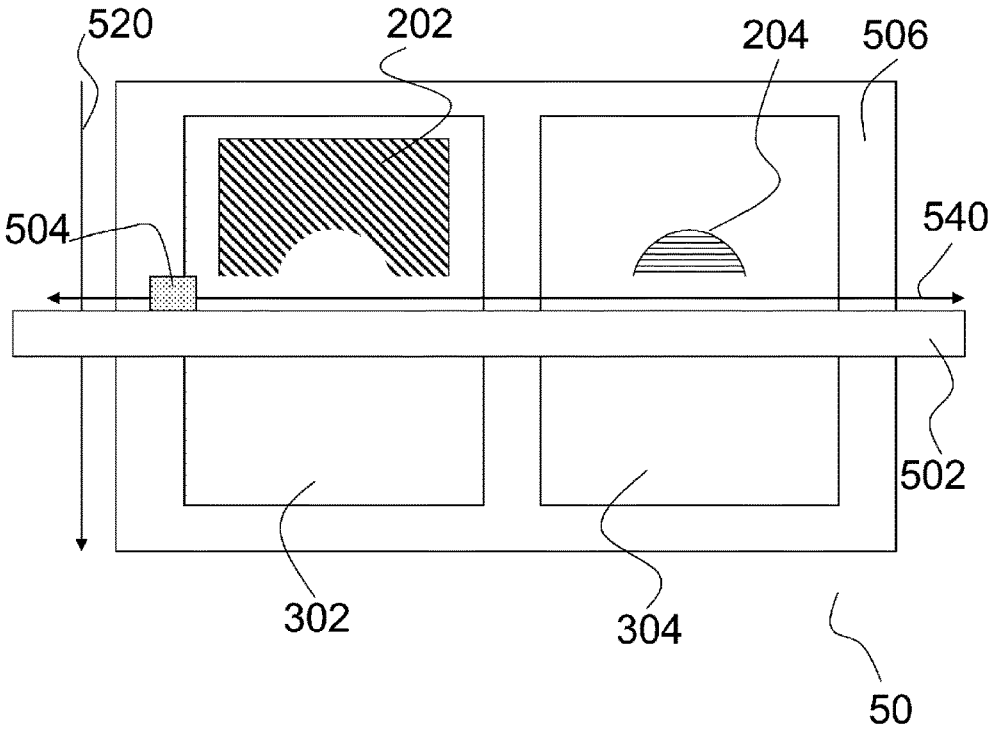
FIG. 3 and FIG. 4 illustrates in analogy of FIG. 2 a topview of the inkjet CTP system (51) the further processing of the forming of parts of the printing areas (202, 204) in a print pass on both lithographic supports (302, 304) wherein the both part of the printing areas (202, 204) corresponds to a part of the colorant separation of the same colour digital image as in FIG. 1. The inkjet printing device (504) is mounted on a gantry (502).
Figure 4:
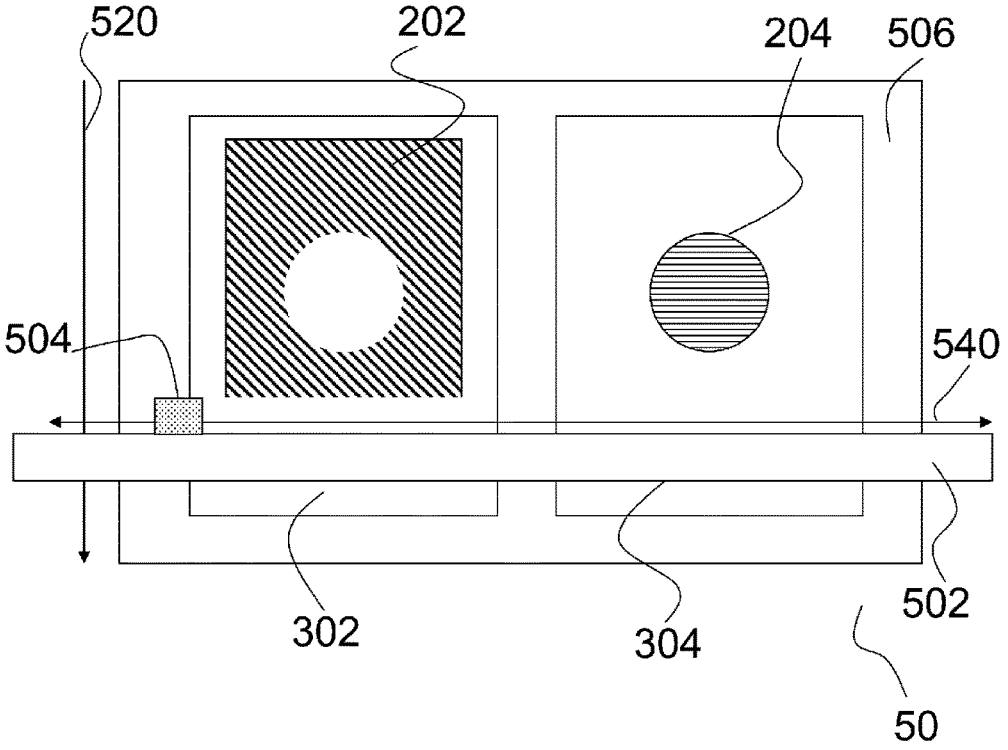
Figure 5:
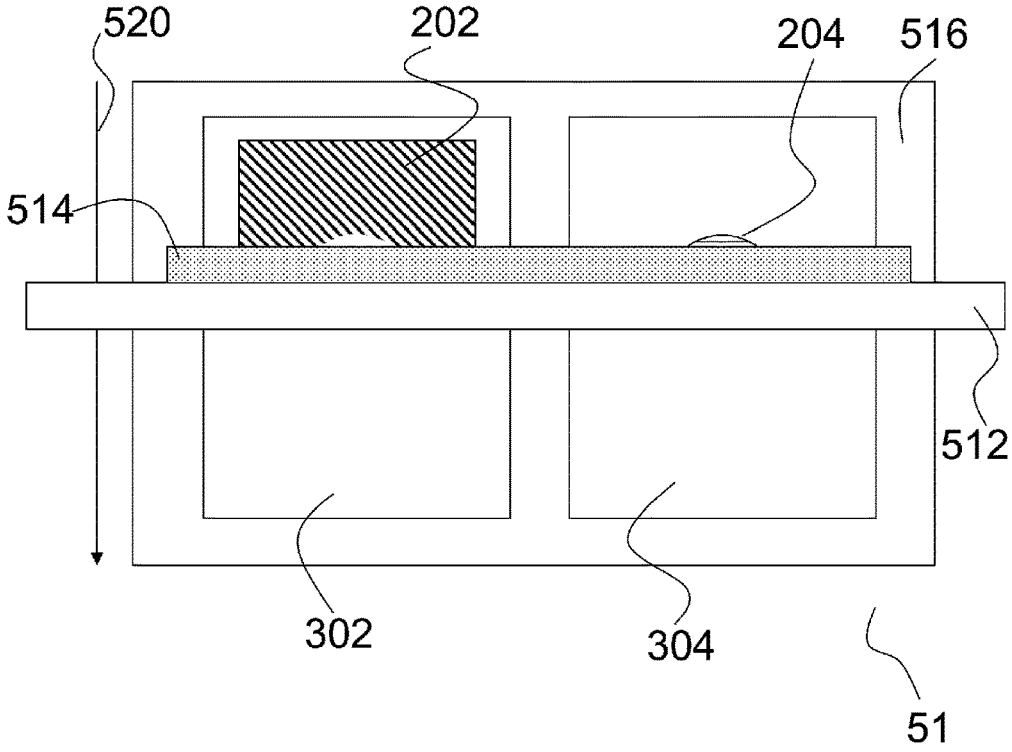
FIG. 5 illustrate a topview of an inkjet CTP system (51) wherein the forming of printing areas is performed by scanning a page-wide inkjet head (514) over the lithographic supports (302, 304) in the transport direction (520) also called a single-pass inkjet printing method. On the first lithographic support a part of the printing area (202), corresponding to the first colorant separation of FIG. 1, is jetted and on the second lithographic support a part of the printing area (202), corresponding to the second colorant separation of FIG. 1, is jetted. The lithographic supports (302, 304) are supported on a support table (516) of the inkjet CTP system (51). The inkjet printing device (514) is mounted on a gantry (512).

A preferred embodiment of the invention is a method of preparing a first and second lithographic printing plate for lithographic printing of a colour digital image on a receiver wherein the colour digital image comprises a plurality of colorant separations; comprising the steps:

jetting droplets by an inkjet CTP system on a first lithographic support for the first lithographic printing plate thereby forming a printing area of a first lithographic image which represents a first colorant separation of the plurality of colorant separations; and jetting droplets by the inkjet CTP system on a second lithographic support for the second lithographic printing plate thereby forming a printing area of a second lithographic image which represents a second colorant separation of the plurality of colorant separations; and wherein the method of preparing a first and second lithographic printing plate is characterized by forming a part of the first and second lithographic image in a print pass by the inkjet CTP system. The parts of the first and second lithographic image is formed thus in a same print pass by an inkjet printing device of the inkjet CTP system. Forming a part of the first and second lithographic image in a print pass by the inkjet printing device is also forming whole the first and second lithographic image in a print pass by an inkjet printing device of the inkjet CTP system.

In a preferred embodiment the forming of a part of the first and second lithographic image is simultaneously by the inkjet CTP system.

In another preferred embodiment the forming of a part of the first and second lithographic image is in a plurality of print passes by the inkjet CTP system.

The preparation of two lithographic printing plates in a print pass on the same inkjet CTP system is done at the same printing condition, such as jetting temperature, head alignment which gives a similar dot placement on both lithographic printing plates which is an advantage of better colour-on-colour registration of the printed colour digital image without demanding alignment methods on the offset press. Another advantage is the speed up of the preparation method by preparing more than one lithographic printing plate at the time. In a preferred embodiment the two lithographic printing plates are in mutual abutment of end faces and in a more preferred embodiment the two lithographic printing plates are fitted together, edge to edge, such as a tongue and groove system.

To achieve a better colour-on-colour registration of the printed colour digital image a preferred embodiment comprises the following steps feeding the first and second lithographic support onto a printing support of the inkjet CTP system; and aligning the first and second lithographic support to be parallel to each other.

The alignment may use of some alignment means such as pins and guiders to position the lithographic support onto the printing support.

The method may comprise preferably three point registration method. A three point registration method aligns three points on the edges of a lithographic support on the support of the CTP system. The lithographic support has a rectangular shape so aligning three points is well-known to be effective to align within sufficiently narrow tolerances.

In a preferred embodiment the method comprises a method wherein the alignment means, such as pins or guiders are retreated away from the inkjet print device. It has to be avoided that the alignment means touch the inkjet print device, such as the nozzle plate of the inkjet print device, which may broke the inkjet print device. The retreating may comprise a step wherein the alignment means are retracted in a printing table which servers as support for the lithographic support on the inkjet CTP system.

One of the problems of alignment means in an inkjet CTP system is that they may touch an inkjet printing device from the inkjet CTP system which may broke the inkjet printing device. The replacement of such an inkjet printing device, such as an inkjet printing head, is expensive. Thus the alignment means have to be constructed so they may not touch the inkjet printing devices of the inkjet CTP system. One way to do so is a preferred embodiment which comprises the following steps;

projecting alignment marks on the printing support; and aligning the first and/or second lithographic support in accordance of the projected alignment marks.

The projecting of alignment marks may be done by an image projector, such as a video projector or slide projector, preferably above the printing support. The projection of the alignment marks may also underneath the printing support through the printing support which is then made of translucent material. An advantage of projecting of alignment marks is the ease of changing to other dimensions of lithographic supports to speed up the preparations. By using pins or guiders as alignment tools instead of projecting alignment marks, the alignment tools have to be changed each time the dimensions of the printing supports changes.

To lithographic print the digital colour image, for example on an offset press, the dimensions of the two lithographic supports are equal. By aligning both lithographic supports to each other, the colour-on-colour registration of the printed colour digital image shall be increased. By measuring the distances between the sides of the same dimension from the lithographic support, the lithographic supports can be controlled to be parallel to each other.

To prepare the first and second lithographic support in a print pass, the colorant separations of the digital colour image may be merged before it is jetted as lithographic image on both lithographic supports by the inkjet CTP system. The merging may be done on both colorant separations to a merged digital image prior a halftoning method or may be merged after a halftoning method on both colorant separations.

A preferred embodiment comprises the following steps:

a1) measuring the position of the first and second lithographic support on the printing support; and b) halftoning the first colorant separation to a first grayscale digital raster image; and c) halftoning the second colorant separation to a second grayscale digital raster image; and d) merging the first and second digital grayscale raster image to a merged digital raster image in accordance with the measured positions; and e) jetting the merged digital raster image on the first and second lithographic supports.

Another preferred embodiment comprises the following steps:

a1) measuring the position of the first and second lithographic support on the printing support;

b) merging the first and second colorant separation to a digital image in accordance with the measured positions; and c) halftoning the merged digital image to a digital raster image; and d) jetting the digital raster image on the first and second lithographic supports.

Prior the step of merging in the latest two preferred embodiments may be comprising the step:

a2) image manipulating, such as rotation, offset, the first colorant separation and/or second colorant separation in accordance with the detected positions.

The image manipulation may comprise the steps:

rotation the first and/or second colorant separation; or translation the first and/or second colorant separation.

Preferably the jetted droplets on the first and second lithographic supports in the embodiment are droplets of the same liquid so the merged digital image or the merged digital raster image is a grayscale digital image.

The step of halftoning in the previous preferred embodiments may be an amplitude modulated screening method or a frequency modulated screening method or an error diffusion method. More information on halftoning is disclosed in JAN P. ALLEBACH, et al. Selected papers on digital halftoning. Edited by JAN P. ALLEBACH. USA: International Society for Optical Engineering, 1999. ISBN 0819431370.

More preferably the jetted droplets on the first lithographic support are droplets of a first liquid and the jetted droplets on the second lithographic supports are droplets of a second liquid so the merged digital image or the merged digital raster image is a colour digital image to distinct from these images the first liquid and second liquid to be jetted by the inkjet CTP system. The first liquid may comprise a pigment or dye of the colorant of the first colorant separation and the second liquid may comprise a pigment or dye of the colorant of the second colorant separation so the look and feel of the lithographic image, more specific the printing areas, on the lithographic support has the same colour or chroma as the colorant of the colorant separation which is represented by the lithographic image. This look and feel facilitates the offset press operator to feed the correct lithographic printing plate in the correct printing tower with the offset ink of the same colorant.

The printing areas may also be jetted by a mixture of droplets from a set of colorant liquids to achieve the same colour or chroma as the colorant of the colorant separation which is represented by the lithographic image.

It is found that the thickness of the cured liquid layers in the printing areas may not deviate much to achieve good quality so preferably the mixture of droplets is achieved by jetting the droplets in the printing area by a dot-off-dot halftoning pattern and more preferably by a pseudo-random dot-off-dot halftoning pattern. A dot-off-dot halftoning pattern minimizes the jetting of droplets of different colorant liquids on top of each other.

If the printing area has a colour, the colour difference dE between the colour of the printing area on the lithographic support and the colorant of the represented colorant separation is preferable from 0 to 10 and/or the chroma difference dC is from 0 to 10 wherein the colour difference dE is calculated by the following formula in CIELab:

$$dE=\sqrt{(L2-L1)+(a2-a1)^2+(b2-b1)^2} \quad \text{Math. 1}$$

and the chroma difference dC is calculated by the following formula in CIELab:

$$dC=\sqrt{(a2-a1)+(b2-b1)^2} \quad \text{Math. 2}$$

More information about colour differences and chroma differences is disclosed in disclosed in DR. R. W. G. HUNT. The reproduction of colour. 4th edition. England: Fountain Press, 1987. Colour differences are measured by colorimeters or colour spectrophotometers.

If the printing area has a colour, in a preferred embodiment the method comprises the step of converting the colour of the colorant from the colorant separation by a color management system in an amount of droplets for each inkjet ink of the plurality of inkjet inks to jet the printing area.

Lithographic Support

The support of the lithographic printing plate has a hydrophilic surface or is provided with a hydrophilic layer. It is also called a lithographic or hydrophilic support. Such a lithographic support has a rectangular shape.

In a preferred embodiment of the invention the support is a grained and anodized aluminium support. By graining and/or roughening the aluminium support, both the adhesion of the printing areas and the wetting characteristics of the non-printing areas are improved. By anodizing the aluminium support, its abrasion resistance and hydrophilic nature are improved.

The lithographic support may also be a flexible support, which may be provided with a hydrophilic layer. The flexible support is e.g. paper, plastic film or aluminium. Preferred examples of plastic film are polyethylene terephthalate film, polyethylene naphthalate film, cellulose acetate film, polystyrene film, polycarbonate film. The plastic film support may be opaque or transparent.

The hydrophilic layer is preferably a cross-linked hydrophilic layer obtained from a hydrophilic binder cross-linked with a hardening agent such as formaldehyde, glyoxal, polyisocyanate or a hydrolyzed tetra-alkylorthosilicate. The latter is particularly preferred. The thickness of the hydrophilic layer may vary in the range of 0.2 to 25 μm and is preferably 1.0 to 10 μm. More details of preferred embodiments of the base layer can be found in e.g. EP-A 1 025 992.

The throw distance of a droplet and the jet straightness influences the accuracy with which the droplet is landed onto a lithographic support. The thickness of a lithographic support in the state of the art from 0.1 until 0.5 mm. Tolerances on the thickness of the lithographic support from ±0.015 are common. Therefore a preferred embodiment comprises the following steps:

measuring the thickness of a lithographic support;

adapting the height between the inkjet printing device and the lithographic support based on the measurement of the thickness of the lithographic support.

The throw distance is by this preferred embodiment controlled to an optimal height between inkjet printing device and lithographic support and thus the drop placement is controlled for a better positioning of the lithographic images on the lithographic supports which results in a better colour-on-colour registration.

Planarity deviation of the lithographic support is common caused for example by bulges or waves in the lithographic support. This influences the throw distance which causes worse dot placement accuracy. Therefore a preferred embodiment comprises the following steps:

measuring the surface topography of a lithographic support; and compensating the height differences in the measured surface topography by controlling the time of firing to jet the droplets on the lithographic support.

The throw distance is by this preferred embodiment optimized and thus the drop placement is controlled for a better positioning of the lithographic images on the lithographic supports which results in a better colour-on-colour registration. Examples of measurement devices to measure the surface topography of a lithographic supports is disclosed in ISO 12635:2008(E).

To know the position of a lithographic support on the printing support of the inkjet CTP system, a detection device, such as a camera or video system, may be attached to the inkjet CTP system. If this position is known, the lithographic image can be optimal positioned on the lithographic support to achieve a better colour-on-colour registration on press. Also there are some tolerances on the rectangularity and the dimensions of a lithographic support. Width and height tolerances of ±1 mm are common. Therefore a preferred embodiment comprises the following steps:

a) measuring the position, the rectangularity and/or dimensions of a lithographic support on the printing support and/or the angle between the lithographic support and a line parallel to an edge of the printing support; and b) jetting the lithographic image on the lithographic support based on the measurements.

The measurements of the lithographic support may be done by an image capturing device such as a digital camera or digital microscope, which captures an image of the lithographic support on the printing support. The image capturing device is than preferably attached to a gantry above the printing support so several images can be captured to detect the lithographic support. A light beam may be attached to the inkjet CTP system, for example to the image capturing device itself, for illuminating the lithographic support. More information on dimensions, regularity and their tolerances of lithographic supports is disclosed in ISO 12635:2008 (E).

If more than one lithographic supports are on the printing support a more preferred embodiment comprises an extra step a1) measuring the position and/or angle between the lithographic supports on the printing support.

Curable Fluids

The droplets that are jetted in the invention are preferably curable fluids and more preferably curable fluids that are substantially water free, which means that water is not intentionally added. Due to the absence of water, a drying step in the plate making process is no longer necessary.

For having a good jettability, the viscosity of the curable fluid at the jetting temperature is preferably smaller than 30 mPa·s, more preferably smaller than 15 mPa·s, and most preferably between 4 and 13 mPa·s at a shear rate of 90 $s^{-1}$ and a jetting temperature between 10 and 70° C.

The viscosity of the curable fluid is preferably smaller than 35 mPa·s, preferably smaller than 28 mPa·s, and most preferably between 2 and 25 mPa·s at 25° C. and at a shear rate of 90 $s^{-1}$.

When using so-called through flow print heads, the viscosity of the curable fluid may be higher, preferably below 60 mPa·s at 25° C. and at a shear rate of 90 $s^{-1}$. A higher viscosity limit for the curable fluids opens up more compositional variations of the fluid making through flow print heads very suitable for the inkjet Computer-to-Plate method according to the present invention.

Any curable fluid with which a hydrophobic printing area can be formed may be used in the method of the present invention. The ink is preferably a non-aqueous UV curable ink. Examples of such UV curable inks are disclosed in EP-A 1637322, EP-A 2199082 and EP-A 253765.

Commercially available inks that may be used are for example the Anapurna®, Anuvia® and Agorix® UV curable inks, all from Agfa Graphics NV.

The curable fluid may also be a so-called hot melt ink. Such an ink is a liquid at jetting temperature and becomes solid on the lithographic support. An example of such an ink is disclosed in EP-A 1266750. In EP-A 2223803 a UV curable hot melt ink is disclosed that gels upon deposition on a support followed by a UV curing step.

As the printing areas of printing plates are typically coloured (to make the printing areas visible), the first curable fluid preferably comprises a colorant.

The colorants used may be dyes, pigments or a combination thereof. An advantage of using a dye may be an improved stability of the ink, i.e. no sedimentation of the pigment. Suitable dyes are for example disclosed in WO2005/111727 page 24, lines 11-32. Preferred dyes are blue coloured dyes, including cyan dyes.

Pigments are preferably used in the present invention due to an improved stability of the colour, for example towards the UV radiation used for curing the first and second curable fluids. Organic and/or inorganic pigments may be used. Suitable pigments are for example disclosed in WO2005/111727 page 21, line 16 to page 24, line 10 and in paragraphs [0128] to [0138] of WO2008/074548. Preferred pigments are blue coloured pigments, including cyan pigments.

The difference in optical density in the printing areas and the non-printing area, i.e. the contrast, has preferably a value of at least 0.3, more preferably at least 0.4, most preferably at least 0.5. There is no specific upper limit for the contrast value, but typically the contrast is not higher than 3.0 or even not higher than 2.0. In order to obtain a good visual contrast for a human observer the type of colour of the colorant may also be important. The optical density can be measured in reflectance using an optical densitometer, equipped with several filters (e.g. red, green, blue).

A Colour Digital Image

A colour digital image, such as RGB-image captured by a digital camera, is a digital image which is made of pixels wherein the pixels are combinations of a set of colorants. A colorant channel, also called a colorant separation, is in this context a grayscale digital image of the same size as the colour digital image, made of just one of the set of colorants.

The colour digital image may be a CMYK-image, which has four colorant channels: cyan (C), magenta (M), yellow (Y) and black (K) or may be CMYKOG-image, which has 6 colorant channels: cyan (C), magenta (M), yellow (Y), black (K), orange (O) and green (G) or other hexachrome-image.

Each colorant channel may be an N bit-image so each pixel may have intensity from 0 to $(2^N-1)$, such as an 8 bit image or 16 bit image.

In a preferred embodiment the colorant of a colorant separation is cyan (C), magenta (M), yellow (Y), black (K), red (R), green (G), blue (B), orange (O), violet (V), white (W), varnish, metallic colour or spot colour, such as a colour selected out the Pantone™ colours.

The colour digital image is converted with a digital halftoning method, such as amplitude modulated screening, frequency modulated screening or error diffusion, to a colour digital raster image. In most inkjet CTP systems the amount of intensities in the colorant channels of the colour digital raster image, also called a grayscale digital raster image, is from 0 to 1. If the inkjet CTP system uses multi-drop piezoelectric inkjet print head to jet the droplets on a lithographic support, the amount of intensities in the colorant channels of the colour digital raster image is from 0 to the amount of droplet volumes the multi-drop piezoelectric inkjet print head jets. The colorant channels of the colour digital raster image are than jetted as lithographic image each on a different lithographic support.

Inkjet CTP Systems

Inkjet CTP systems is a marking device that is using an inkjet printing device such as valve-jet print device, an inkjet print head, page-wide inkjet arrays or an inkjet printing head assembly with one or more inkjet print heads to jet droplets of a liquid to form printing areas of the lithographic image so to prepare a lithographic printing plate comprising the lithographic image.

The inkjet CTP system may be a flat bed printing system wherein the lithographic support is positioned horizontal (=parallel to the ground) or vertical on a flat printing support in the inkjet CTP system or the inkjet CTP system may be a drum based inkjet printing system wherein the lithographic support is wrapped around a cylindrical printing support in the inkjet CTP system.

In a preferred embodiment the inkjet CTP system has a printing width larger than 1 meter. Larger the printing width, larger the lithographic printing plates can be prepared. Larger the printing width, larger the amount of preparing lithographic printing plates in a print pass is possible. The inkjet CTP system has preferably a print width from 1 meter until 5 meter more preferably from 2 meter until 5 meter and most preferably from 1.5 meter until 3.5 meter.

In a preferred embodiment the inkjet CTP system has holding down means, such as a vacuum chamber under the printing support, to hold down the lithographic supports in a hold down zone, for example by vacuum force. In a more preferred embodiment the lithographic supports are hold down against the printing support by independent working holding down means such as a plurality of vacuum chambers under the printing support which are independently controlled to enhance the vacuum pressure on the printing support so more than one hold down zones are generated on the printing support. The holding down of the lithographic supports enhances the drop placement of the jetted droplets and position accuracy of the lithographic image which gives a better alignment and colour-on-colour registration when printing the colour digital image with the prepared lithographic printing plates on an offset press.

To allow different dimensions of lithographic supports, a preferred embodiment comprises the step of changing the dimension of a first hold down zone on the printing support to hold down the first lithographic support and the step of changing the dimension of a second hold down zone on the printing support to hold down the second lithographic support. This may for example achieved by dividing a vacuum chamber under the printing support by one or more movable walls which divide the vacuum chamber in a plurality of vacuum chambers.

The inkjet printing device in an inkjet CTP system may scans back and forth in a transversal direction across the moving of the lithographic supports. This method is also called multi pass inkjet printing. The preparation of the first and second lithographic printing plate is with a multi pass inkjet printing method characterized by forming the printing areas in a plurality of printing passes. In a multi-pass printing method shingling and interlacing methods may be used as exemplified by EP 1914668 (AGFA-GEVAERT) or print mask methods may be used as exemplified by U.S. Pat. No. 7,452,046 (HEWLETT-PACKARD). The print mask in a print masks method is preferably a pseudo-random distribution mask and more preferably a pseudo-random distribution with blue-noise characteristics.

In a preferred method the jetting of the droplets is performed by single pass inkjet printing, which can be performed by using page wide inkjet printing device, such as a page wide inkjet print head or multiple staggered inkjet print heads which cover the total width of the lithographic supports. In a single pass inkjet printing method the inkjet print heads usually remain stationary and the lithographic supports are transported once under the page wide inkjet printing device. An advantage of single pass inkjet printing is the fastness of preparation of the lithographic printing plates and a better drop placement of the jetted droplets which give a better alignment and colour-on-colour registration when printing the colour digital image with the prepared lithographic printing plates on an offset press.

An inkjet CTP system may comprise a color management system to convert the colour of the colorant from the colorant separation by an inverted N-inkjet ink-model of the inkjet CTP system to an amount of droplets for each inkjet ink of the plurality of inkjet inks to jet the printing area.

If the height between the inkjet printing device and the lithographic supports varies due to the non-planarity of a printing table, which is capable of supporting multiple lithographic supports, it has effect on the throw distances which causes worse dot placement accuracies. Therefore in a preferred embodiment of the present invention comprises the following steps:

assigning a first printing zone on the printing support for a first colorant; and checking the colorant of the first colorant separation and feeding the first lithographic printing plate onto the first printing zone if the colorant of the first colorant separation is the same as the first colorant.

In this preferred embodiment a lithographic support is fed on the printing table in an assigned print zone depending on the colorant of the colorant separation which shall be formed on the lithographic support. The lithographic printing plates, wherein the colorant of the colorant separations is the same, have the same dot placement accuracy which is an advantage to the press operator to have a minimal work-load to register the lithographic printing plate on press.

Inkjet Printing Device

An inkjet printing device may be a valve-jet print device, an inkjet print head, page-wide inkjet arrays or an inkjet printing head assembly with one or more inkjet print heads A preferred inkjet printing device for the inkjet CTP system comprises a piezoelectric inkjet print head. Piezoelectric inkjet printing is based on the movement of a piezoelectric ceramic transducer when a voltage is applied thereto. The application of a voltage changes the shape of the piezoelectric ceramic transducer in the print head creating a void, which is then filled with ink. When the voltage is again removed, the ceramic expands to its original shape, ejecting a drop of ink from the print head. However the inkjet printing method according to the present invention is not restricted to piezoelectric inkjet printing. Other inkjet printing devices may be used and include various types, such as a continuous type.

More information about inkjet print devices is disclosed in STEPHEN F. POND. Inkjet technology and Product development strategies. United States of America: Torrey Pines Research, 2000. ISBN 0970086008.

To obtain a sufficient resolution of the lithographic printing plates, for example 1200 or 1800 dpi, preferred inkjet printing devices, such as piezoelectric inkjet print heads, jets droplets having a volume smaller than 15 pl, more preferably smaller than 10 pl, most preferably smaller than 5 pl, particularly preferred smaller than 3 pl.

A more preferred inkjet printing device for the inkjet CTP system comprises a multi-drop piezoelectric inkjet print head. A multi-drop piezoelectric print head, also called a grayscale piezoelectric print head, is capable of jetting droplets in a plurality of volumes, such as the Konica Minolta™ KM1024i, to improve the quality of the lithographic images on the lithographic supports.

Another more preferred inkjet printing device for the inkjet CTP system is a through-flow piezoelectric inkjet print head. A through-flow piezoelectric inkjet print head is a print head wherein a continuous flow of liquid is circulating through the liquid channels of the print head to avoid agglomerations in the liquid which may cause disturbing effects in the flow and bad drop placements. Avoiding of bad drop placements by using through-flow piezoelectric inkjet print heads is an advantage on the colour-on-colour registration when printing the colour digital image with the prepared lithographic printing plates on an offset press.

Curing Devices

In a preferred embodiment the jetted droplets are from a curable fluid that is cured on the lithographic supports by actinic radiation, more preferably to ultraviolet radiation. By curing, the jetted droplets are stabilized to the lithographic support. The stabilization of the jetted droplets on the lithographic support ensures the drop placement. To ensure a consistent dot size of the jetted drop, the curing of the jetted droplets is preferably immediately after impacting the lithographic support.

The curing device, such as a set of UV bulb lamps or a set of UV LED lamps may travelling with the inkjet printing device and/or be stationary attached as an elongated radiation source.

Any ultraviolet light source, as long as part of the emitted light can be absorbed by the photo-initiator or photo-initiator system in the liquid, may be employed as a radiation source, such as a high or low pressure mercury lamp, a cold cathode tube, a black light, an ultraviolet LED, an ultraviolet laser, and a flash light. Of these, the preferred source is one exhibiting a relatively long wavelength UV-contribution having a dominant wavelength of 300-400 nm. Specifically, a UV-A light source is preferred due to the reduced light scattering therewith resulting in more efficient interior curing.

UV radiation is generally classed as UV-A, UV-B, and UV-C as follows:

UV-A: 400 nm to 320 nm

UV-B: 320 nm to 290 nm

UV-C: 290 nm to 100 nm.

In a preferred embodiment, the curing device contains a set of UV LEDs with a wavelength larger than 360 nm, preferably one or more UV LEDs with a wavelength larger than 380 nm, and most preferably UV LEDs with a wavelength of about 395 nm.

An advantage of using a set of UV LEDs as curing device is the fast changement of power. For example if in a preferred embodiment there is more than one liquid to prepare the lithographic printing plates, the power of the UV LEDs can be changed rapidly depending on which liquid is jetted. Or for example the power of the UV LEDs can be changed rapidly depending on the amount of droplets in a printing area on the lithographic supports For facilitating curing, the printing device often includes one or more oxygen depletion units. The oxygen depletion units place a blanket of nitrogen or other relatively inert gas (e.g. $CO_2$), with adjustable position and adjustable inert gas concentration, in order to reduce the oxygen concentration in the curing environment. Residual oxygen levels are usually maintained as low as 200 ppm, but are generally in the range of 200 ppm to 1200 ppm.

Curing may be "partial" or "full". The terms "partial curing" and "full curing" refer to the degree of curing, i.e. the percentage of converted functional groups, and may be determined by, for example, RT-FTIR (Real-Time Fourier Transform Infra-Red Spectroscopy) which is a method well known to the one skilled in the art of curable formulations. Partial curing is defined as a degree of curing wherein at least 5%, preferably 10%, of the functional groups in the coated formulation or the fluid droplet is converted. Full curing is defined as a degree of curing wherein the increase in the percentage of converted functional groups with increased exposure to radiation (time and/or dose) is negligible. Full curing corresponds with a conversion percentage that is within 10%, preferably 5%, from the maximum conversion percentage. The maximum conversion percentage is typically determined by the horizontal asymptote in a graph representing the percentage conversion versus curing energy or curing time.

Belt Step Conveyor System

The inkjet CTP device may comprise a belt step conveyor wherein the conveyor belt carries the lithographic supports by moving from a start location to an end location in successive distance movements also called discrete step increments. In a belt step conveyor, the conveyor belt is wrapped around minimum two pulleys. By moving the lithographic supports by successive distance movements the alignment of the lithographic supports may controlled between the movements.

The conveyor belt may have a sticky cover which holds the lithographic supports on the conveyor belt while it is carried from start location to end location. Said conveyor belt is also called a sticky conveyor belt. The advantageous effect of using a sticky conveyor belt allows an exact positioning of the lithographic supports on the sticky conveyor belt. Another advantageous effect is that the lithographic support shall not be stretched and/or deformed while the lithographic support is carried from start location to end location. The adhesive on the cover is preferably activated by an infrared drier to make the conveyor belt sticky. The adhesive on the cover is more preferably a removable pressure sensitive adhesive. The holding down of the lithographic supports on the conveyor belt enhances the drop placement of the jetted droplets and position accuracy of the lithographic image which gives a better alignment and colour-on-colour registration when printing the colour digital image with the prepared lithographic printing plates on an offset press.

Another way to make the conveyor belt sticky is the use of synthetic setae which are a simulation of the structure of the setae of a gecko in synthetic material. A group of synthetic setae on a material with a package density of more than 100 synthetic setae per square millimeter is also called gecko tape. In a preferred embodiment the conveyor belt comprises synthetic setae to hold down the lithographic supports. A preferred embodiment, with an inkjet CTP system comprising a sticky conveyor belt comprises the step: adhering the lithographic supports on the sticky conveyor belt. The holding down of the lithographic supports by adhesion on the conveyor belt enhances the drop placement of the jetted droplets and position accuracy of the lithographic image which gives a better alignment and colour-on-colour registration when printing the colour digital image with the prepared lithographic printing plates on an offset press.

A preferred embodiment, with an inkjet CTP system comprising a conveyor belt to carry the lithographic supports, comprises the following repeating steps to move the lithographic supports in successive distance movements in a conveying direction:

a) a first belt gripper engages the conveyor belt and a second belt gripper releases the conveyor belt;

b) moving the first belt gripper by driving a first linear movement system from a home position to an end position;

c) the second belt gripper engages the conveyor belt and the first belt gripper releases the conveyor belt;

d) moving the first belt gripper by driving the first linear movement system from the end position to the home position.

The advantageous effect of this preferred embodiment is that no slip occurs contrary to the belt step conveyor systems driven by a stepper motor to power a pulley. The exact positioning capabilities are also accurate and less tension force is needed on the conveying belt to strengthen the resilience and tensioning of the conveying belt. Other advantages are the ease of implementation and use of the linear movement system in the embodiment of the belt step conveyor system to calculate the exact positioning of the load on the conveying belt and the engaging of the second belt gripper while the first belt gripper is returning to its end position to ensure the stagnation of the conveying belt and a lithographic support on the conveying belt. This gives a more accurate positioning capability of the lithographic supports and thus a better colour-on-colour registration when printing the colour digital image with the prepared lithographic printing plates on an offset press.

Other Preferred Embodiment

Another invention but related and comparable to the present invention, wherein all preferred embodiments of the present invention are also applicable for this other invention, is the following preferred embodiment:

A method of preparing a first and third lithographic printing plate for lithographic printing of a first colour digital image on a first receiver wherein the first colour digital image comprises:

a first colorant separation for a first colorant; and a second colorant separation for a second colorant; and preparing a second and fourth lithographic printing plate for lithographic printing of a second colour digital image on a second receiver wherein the second colour digital image comprises:

a third colorant separation for the first colorant; and a fourth colorant separation for the second colorant;

comprising the steps:

assigning a first printing zone for the first colour digital image on a printing support of an inkjet CTP system; and assigning a second printing zone for the second colour digital image on the printing support of the inkjet CTP system;

preparing the first and second lithographic support by:

a) feeding the first lithographic support to the first printing zone; and b) feeding the second lithographic support to the second printing zone; and c) jetting droplets by the inkjet CTP system on a first lithographic support for the first lithographic printing plate thereby forming a printing area of a first lithographic image which represents the first colorant separation; and d) jetting droplets by the inkjet CTP system on a second lithographic support for the second lithographic printing plate thereby forming a printing area of a second lithographic image which represents the third colorant separation; and preparing the second and fourth lithographic support by:

e) feeding the third lithographic support to the first printing zone; and f) feeding the fourth lithographic support to the second printing zone; and g) jetting droplets by the inkjet CTP system on a third lithographic support for the third lithographic printing plate thereby forming a printing area of a third lithographic image which represents the second colorant separation; and h) jetting droplets by the inkjet CTP system on a fourth lithographic support for the fourth lithographic printing plate thereby forming a printing area of a fourth lithographic image which represents the fourth colorant separation.

In a preferred embodiment the lithographic printing plates are in mutual abutment of end faces and in a more preferred embodiment the lithographic printing plates are fitted together, edge to edge, such as a tongue and groove system.

In this embodiment of the other invention the lithographic printing plates of the same colour digital image is jetted in the same printing zone of the printing support of the inkjet CTP system so they have the same dot placement accuracy, determined by the height of the printing support in its printing zone, which is advantage for colour-on-colour registration on press.

In a preferred embodiment of the other invention the method is characterized by forming a part the first and third lithographic image in a same print pass by the inkjet CTP system. The preparation of two lithographic printing plates in a same print pass on the same inkjet CTP system is done at the same printing condition, such as jetting temperature, head alignment which gives a similar dot placement on both lithographic printing plates which is an advantage of better colour-on-colour registration of the printed colour digital image without demanding alignment methods on the offset press. Another advantage is the speed up of the preparation method by preparing more than one lithographic printing plate at the time.

To achieve a better colour-on-colour registration of the printed colour digital image a preferred embodiment of the other invention comprises the following steps feeding the first and second lithographic support onto a printing support of the inkjet CTP system; and aligning the first and second lithographic support to be parallel to each other. The alignment may use of some alignment means such as pins and guiders to position the lithographic support onto the printing support.

The method may comprise preferably three point registration method. A three point registration method aligns three points on the edges of a lithographic support on the support of the CTP system. The lithographic support has a rectangular shape so aligning three points is well-known to be effective to align within sufficiently narrow tolerances.

One of the problems of alignment means in an inkjet CTP system is that they may touch an inkjet printing device from the inkjet CTP system which may broke the inkjet printing device. The replacement of such an inkjet printing device, such as an inkjet printing head, is expensive. Thus the alignment means have to be constructed so they may not touch the inkjet printing devices of the inkjet CTP system. One way to do so is a preferred embodiment of the other invention which comprises the following steps projecting alignment marks on the printing support; and aligning the first and/or second lithographic support in accordance of the projected alignment marks. The projecting of alignment marks may be done by an image projector, such as a video projector or slide projector, preferably above the printing support. The projection of the alignment marks may also underneath the printing support through the printing support which is than made of translucent material. An advantage of projecting of alignment marks is the ease of changing to other dimensions of lithographic supports to speed up the preparations. By using pins or guiders as alignment tools instead of projecting alignment marks, the alignment tools have to be changed each time the dimensions of the printing supports changes.

REFERENCE SIGNS LIST

TABLE 1

| | |
|---|---|
| 10 | Colour digital image |
| 102 | Colorant separation |
| 104 | Colorant separation |
| 50 | Inkjet CTP system |
| 51 | Inkjet CTP system |
| 520 | Slowscan direction |
| 540 | Fastscan direction |
| 302 | Lithographic support |
| 304 | Lithographic support |
| 202 | Part of a printing area |
| 204 | Part of a printing area |
| 516 | Support table |
| 504 | Inkjet printing device |
| 502 | Gantry |
| 514 | Page-wide inkjet head |

The invention claimed is:

1. A method of preparing a first lithographic printing plate and a second lithographic printing plate for lithographic printing of a color digital image on a receiver wherein the color digital image includes a plurality of colorant separations, the method comprising the steps of:

jetting droplets with an inkjet CTP system on a first lithographic support of the first lithographic printing plate to form a printing area of a first lithographic image that represents a first colorant separation of the plurality of colorant separations;

jetting droplets with the inkjet CTP system on a second lithographic support of the second lithographic printing plate to form a printing area of a second lithographic image that represents a second colorant separation of the plurality of colorant separations;

forming a portion of the first lithographic image and a portion of the second lithographic image in a same print pass by an inkjet printing device of the inkjet CTP system;

feeding the first lithographic support and the second lithographic support onto a printing support of the inkjet CTP system;

aligning the first lithographic support and the second lithographic support to be parallel to each other; and prior to the step of jetting the droplets, performing the steps of:

measuring a position of the first lithographic support and the second lithographic support on the printing support; and merging the first colorant separation and the second colorant separation into a digital image in accordance with the measured positions; and halftoning the digital image to a digital raster image.

2. The method according to the claim 1, further comprising the step of:

manipulating an image in the first colorant separation and/or the second colorant separation in accordance with the measured positions.

3. The method according to the claim 2, wherein the image manipulating step includes the steps of:

rotating the first colorant separation and/or the second colorant separation; or translating the first colorant separation and/or the second colorant separation.

4. The method according to claim 1, wherein the printing area of the first lithographic image is formed by jetting droplets of one or more color liquids to achieve a same color as the first colorant separation.

5. The method according claim 1, wherein, while jetting the droplets on the first lithographic support and the second lithographic support:

holding down the first lithographic support in a first hold down zone on the printing support; and holding the second lithographic support in a second hold down zone on the printing support.

6. The method according to claim 1, further comprising the steps of:

projecting alignment marks on the printing support; and aligning the first lithographic support and/or the second lithographic support in accordance of the alignment marks.

7. The method according to claim 1, further comprising the steps of:

measuring a surface topography of the first lithographic support and the second lithographic support; and compensating for height differences in the surface topography by controlling a time of firing of the droplets on the first lithographic support and the second lithographic support.

8. The method according to claim 1, wherein the inkjet CTP system is a single pass inkjet system.

9. The method according to claim 1, further comprising the step of:

solidifying the droplets jetted on the first lithographic support and the second lithographic support with radiation.

10. The method according to claim 1, wherein a smallest volume of one of the droplets is from 1.5 pL to 15 pL.

11. The method according to claim 1, further comprising the steps of:

assigning a printing zone on the printing support for a first colorant; and checking a colorant of the first colorant separation and feeding the first lithographic printing plate onto the printing zone if the colorant of the first colorant separation is the same as the first colorant.

12. The method according to claim 1, wherein the inkjet CTP system includes a conveyor belt to carry the first lithographic support and the second lithographic support, and the method further comprises repeating a step of:

moving the first lithographic support and the second lithographic support in successive distance movements in a conveying direction.

13. The method according to claim 1, wherein the inkjet CTP system has a printing width from 1 meter to 5 meters.

* * * * *